US011037537B2

(12) United States Patent
Huo et al.

(10) Patent No.: US 11,037,537 B2
(45) Date of Patent: Jun. 15, 2021

(54) METHOD AND APPARATUS FOR MUSIC GENERATION

(71) Applicants: Xiaoye Huo, Shenyang (CN); Daimeng Wang, Beijing (CN); Salman Habib, Bangladesh (BD); Yipeng Zhang, Beijing (CN); Yongjian Wang, Tianjin (CN); Zhian Mi, Suzhou (CN); Wenhong Qu, Beijing (CN); Gen Yin, Changchun (CN); Xin Yin, Qianghu (CN)

(72) Inventors: Xiaoye Huo, Shenyang (CN); Daimeng Wang, Beijing (CN); Salman Habib, Bangladesh (BD); Yipeng Zhang, Beijing (CN); Yongjian Wang, Tianjin (CN); Zhian Mi, Suzhou (CN); Wenhong Qu, Beijing (CN); Gen Yin, Changchun (CN); Xin Yin, Qianghu (CN)

( * ) Notice: Subject to any disclaimer, the term of this patent is extended or adjusted under 35 U.S.C. 154(b) by 0 days.

(21) Appl. No.: 16/434,086

(22) Filed: Jun. 6, 2019

(65) Prior Publication Data

US 2020/0066240 A1 Feb. 27, 2020

Related U.S. Application Data

(60) Provisional application No. 62/723,342, filed on Aug. 27, 2018.

(51) Int. Cl.

| | |
|---|---|
| ***G10H 1/00*** | (2006.01) |
| ***G10H 1/06*** | (2006.01) |
| ***G10H 1/38*** | (2006.01) |
| ***G10G 1/02*** | (2006.01) |

(52) U.S. Cl.

CPC ..... *G10H 1/0025* (2013.01); *G10G 1/02* (2013.01); *G10H 1/06* (2013.01); *G10H 1/383* (2013.01); *G10H 2240/311* (2013.01)

(58) Field of Classification Search

CPC ..... G10H 1/0025; G10H 1/06; G10H 1/383; G10H 2240/311; G10G 1/02

See application file for complete search history.

(56) References Cited

U.S. PATENT DOCUMENTS

| | | | | |
|---|---|---|---|---|
| 5,281,754 A * | 1/1994 | Farrett | ..... | G10H 1/0025 84/609 |
| 2002/0007722 A1* | 1/2002 | Aoki | ..... | G10H 1/0025 84/635 |
| 2007/0291958 A1* | 12/2007 | Jehan | ..... | G10H 1/0025 381/103 |
| 2009/0064851 A1* | 3/2009 | Morris | ..... | G10H 1/0025 84/637 |

(Continued)

*Primary Examiner* — Jeffrey Donels

(74) *Attorney, Agent, or Firm* — Che-Yang Chen; Law Office of Michael Chen

(57) ABSTRACT

A method and apparatus for music generation may include steps of receiving any length of input; recognizing pitches and rhythm of the input; generating a first segment of a full music; generating segments other than the first segment to complete the full music; generating connecting notes, chords and beats of the segments of the full music and handling anacrusis; and generating instrument accompaniment for the full music, and comprise a music generating system to realize the steps of music generation.

5 Claims, 7 Drawing Sheets

(56) References Cited

U.S. PATENT DOCUMENTS

| | | | | |
|---|---|---|---|---|
| 2014/0076125 | A1* | 3/2014 | Kellett | G10H 7/00 84/609 |
| 2016/0163297 | A1* | 6/2016 | Trebard | G10H 1/0025 84/610 |
| 2019/0251941 | A1* | 8/2019 | Sumi | G10H 1/0008 |
| 2019/0266988 | A1* | 8/2019 | Sumi | G10H 1/383 |

* cited by examiner

METHOD AND APPARATUS FOR MUSIC GENERATION

FIELD OF THE INVENTION

The present invention relates to a method and apparatus for music generation and more particularly to a method and apparatus for generating a piece of music after receiving any length of input such as a segment of sound or music.

BACKGROUND OF THE INVENTION

Along with the time progress, music has become a big part of human life, and people can easily access to music almost anytime and anywhere. Some people like lyricists and composers are good at creating melody, chord, beat or a complete music, and they can even rely on producing music to make a living. However, not everyone has his/her talent in creating music, and, for those people, it may be wonderful when they can create his/her own works through a music generation method and apparatus. Therefore, there remains a need for a new and improved design for a method and apparatus for music generation to overcome the problems presented above.

SUMMARY OF THE INVENTION

The present invention provides a method and apparatus for music generation which may include steps of receiving an any length of input; recognizing pitches and rhythm of the input; generating a first segment of a full music; generating segments other than the first segment to complete the full music; generating connecting notes, chords and beats of the segments of the full music and handling anacrusis; and generating instrument accompaniment for the full music.

Techniques for sound extractions are employed in sound processing and several data representations, and the key features of input are configured to be extracted according to the characteristics of input sounds. The step of recognizing pitches and rhythm of the input is a signal processing of the input, and the frame of a generated music is generated in this step including an initial short melody and an initial bars and time signature.

After the frame of the generated music is generated, the sound input is processing through a deep learning system to generate a first segment of a full music and segments other than the first segment to complete a full music in sequence. Furthermore, each of the two steps is completed through the deep learning system including steps of extracting music instrument digital interface (MIDI); extracting melody; extracting chord; extracting beat; and extracting music progression of the input sound.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
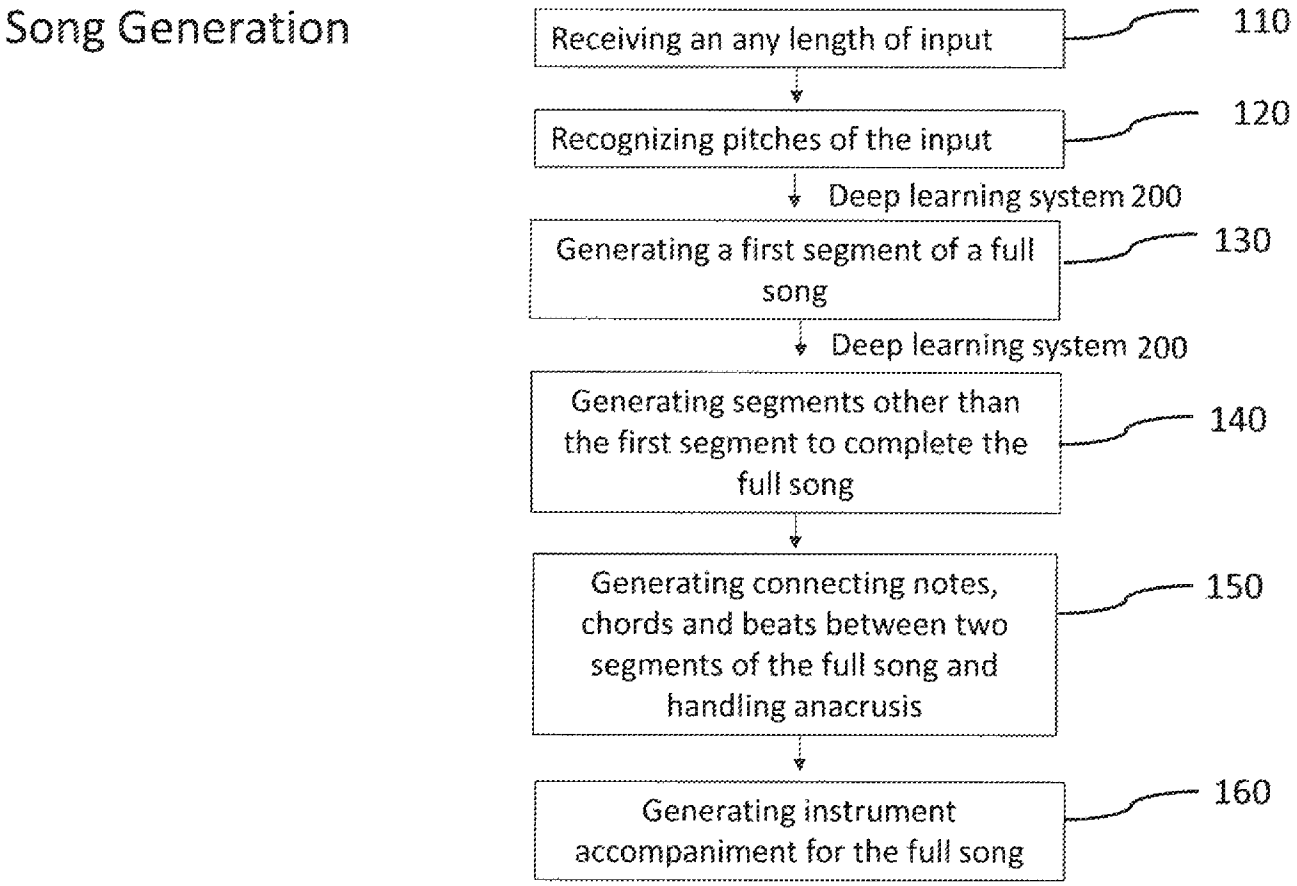
FIG. 1 is a flow chart of a method and apparatus for music generation of the present invention.
Figure 2:
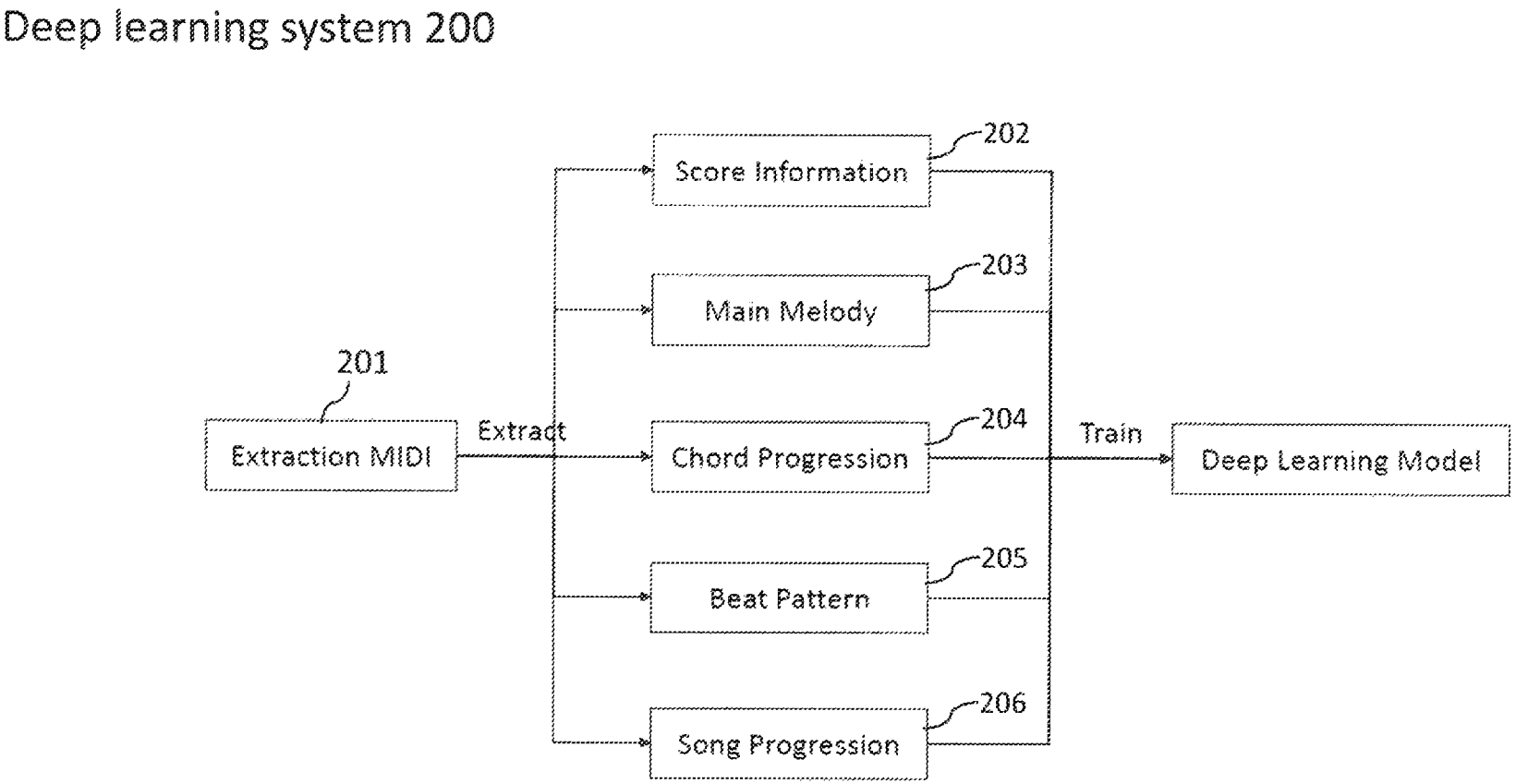
FIG. 2 is a flow chart illustrating the processing of a deep learning system of the method and apparatus for music generation in the present invention.

In order to further understand the goal, characteristics and effect of the present invention, a number of embodiments along with the drawings are illustrated as following:

Referring to FIG. 1, the present invention provides a method and apparatus for music generation, and the method for music generation may include steps of receiving any length of input (110); recognizing pitches and rhythm of the input (120); generating a first segment of a full music (130); generating segments other than the first segment to complete the full music (140); generating connecting notes, chords and beats of the segments of the full music and handling anacrusis (150); and generating instrument accompaniment for the full music (160).

Techniques for sound extractions are employed in sound processing and several data representations, and the key features of input are configured to be extracted according to the characteristics of input sounds. The step of recognizing pitches and rhythm of the input (120) is a signal processing of the input, wherein the frame of a generated music is generated in this step including an initial short melody and an initial bars and time signature, and the data representations of generating the initial short melody (Equation 1) and the initial bars and time signatures (Equation 2) are shown as below:

$$M_0=\{n_{M_0 1}, \ldots, n_{M_0 |M_0|}\}$$

$$n_{M_0 j}=(t_{M_0 j}, d_{M_0 j}, h_{M_0 j}, v_{M_0 j})$$

$n_{M_0 j}$: jth note of melody
$t_{M_0 j}$: Starting tick of jth note of melody
$d_{M_0 j}$: Duration (ticks) of jth note of melody
$h_{M_0 j}$: Pitch of jth note of melody
$v_{M_0 j}$: Velocity of jth note of melody Notes in main melody does not overlap Equation 1. Data Representations of Generating Initial Short Melody $$B_0=\{b_{0,1}, \ldots, b_{0,|B_0|}\}$$

$$b_{0,i}=(t_{b_{0,i}}, s_{b_{0,i}})$$

$t_{b_0 i}$: Ending tick of the ith bar.

$s_{b_0 i}$: Time signature of ith bar.

Figure 4:
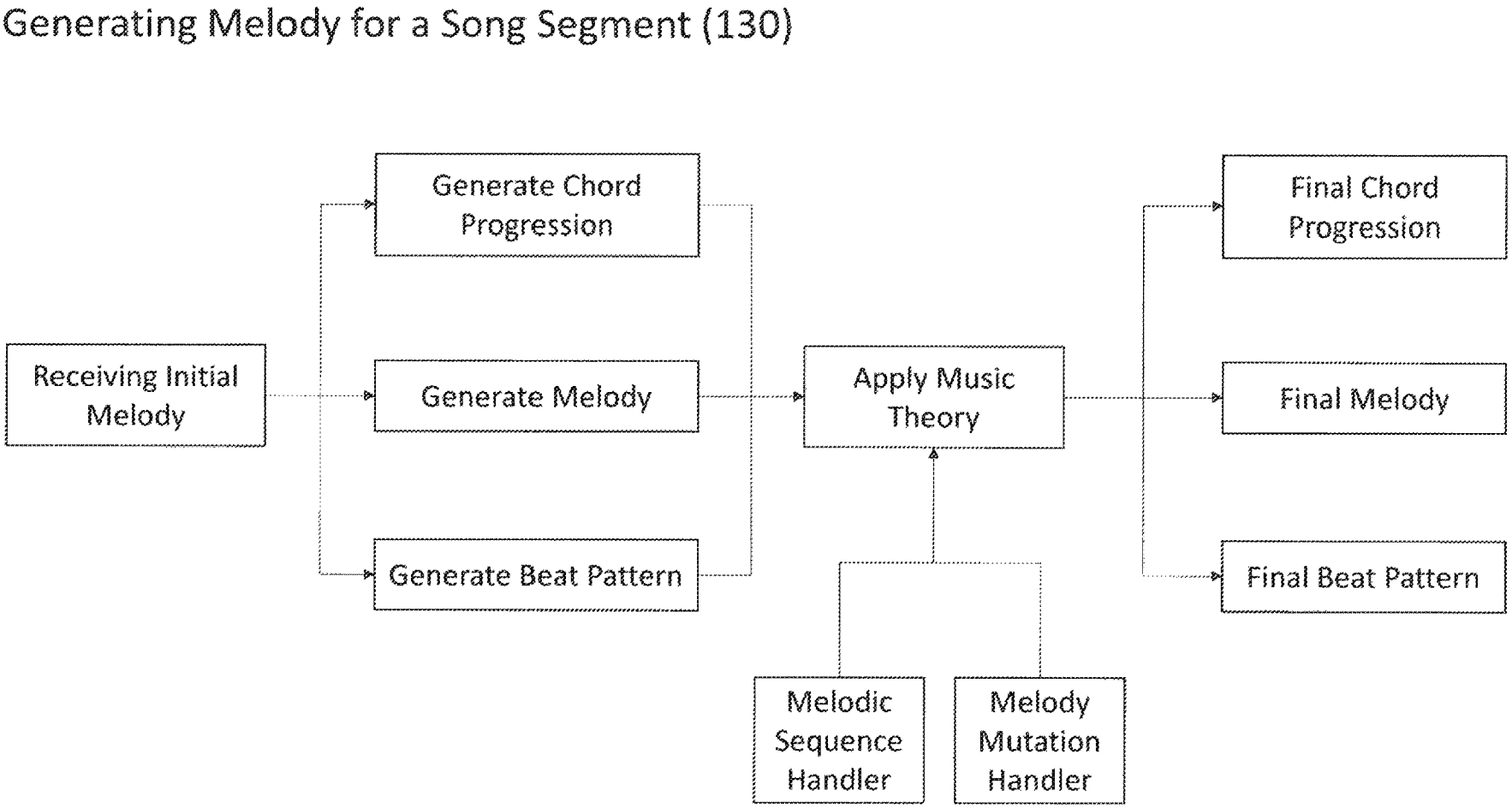
FIG. 4 is a flow chart of step 130 of the method and apparatus for music generation of the present invention.
Figure 5:
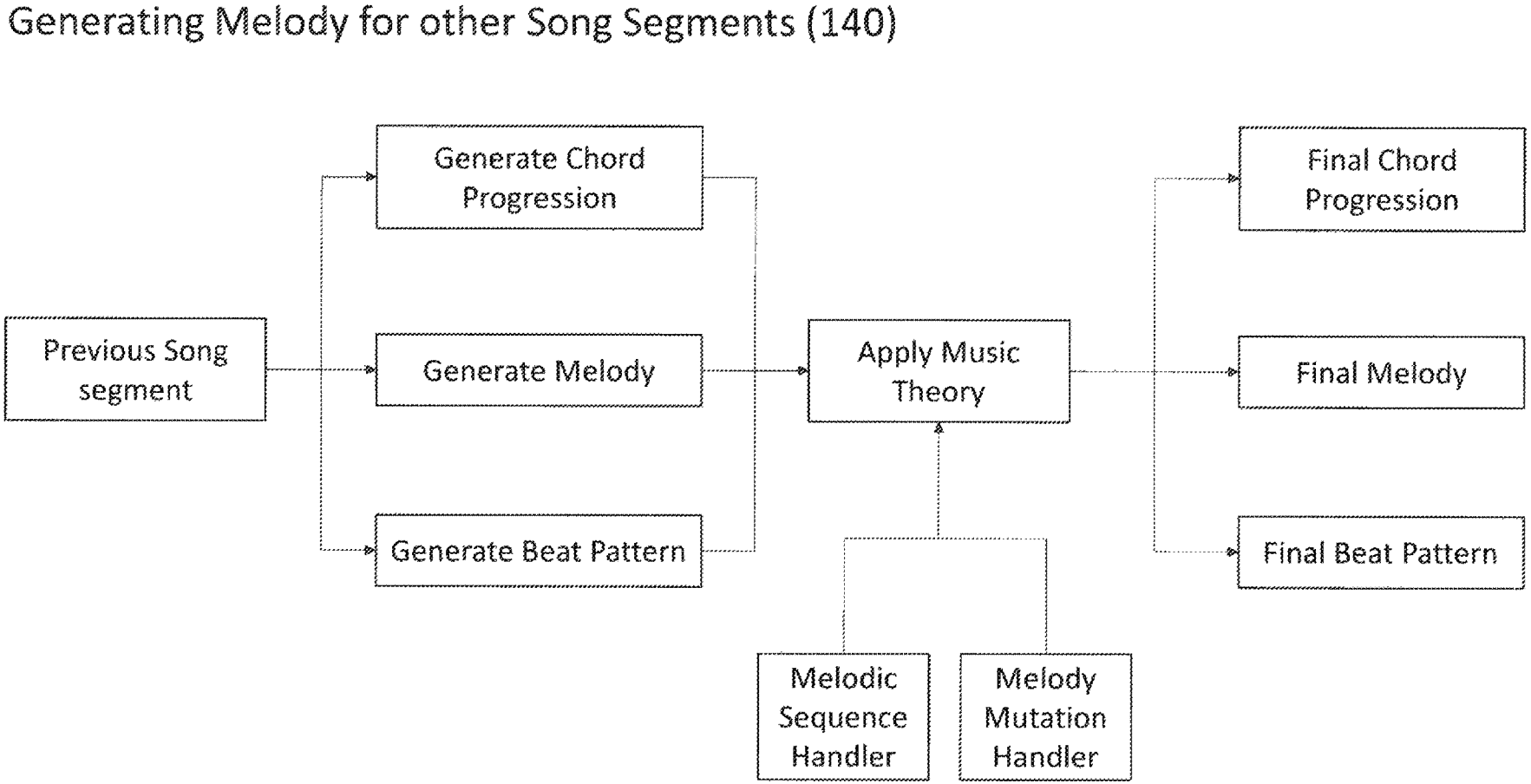
FIG. 5 is a flow chart of step 140 of the method and apparatus for music generation of the present invention.

At this point the time signature for each bar should be same: $\forall 1 \leq i < j \leq |B_0|$, $s_{b_0 i}=s_{b_0 j}$ Equation 2. Data Representations of Generating Initial Bars & Time Signatures After the frame of the generated music is generated, the sound input is processing through a deep learning system (200) to generate a first segment of a full music (130) and segments other than the first segment to complete a full music (140) in sequence. Furthermore, each of the two steps (130) (140) is completed through the deep learning system (200) including steps of extracting music instrument digital interface (MIDI) from the music input (201); extracting score information from the MIDI (202); extracting a main melody from the MIDI (203); extracting a chord progression from the MIDI (204); extracting a beat pattern from the MIDI (205); extracting a music progression from the MIDI (206); and applying a music theory to the melody, chord progression and beat pattern extracted in steps 203 to 205 (207) as shown in FIGS. 4 and 5. In the step of extracting MIDI (201), the deep learning system (200) is configured to translate MIDI of the input sound in step 110 to more readable format for the deep learning system (200). Then, through the deep learning system (200), score information, main melody, chord progression, beat pattern, and music progression of the music are acquired after the MIDI information of the sound input is extracted. In one embodiment, the score information is specified at the beginning of MIDI, and the score information can be directly acquired. In one embodiment, the music theory may include a music sequence handler and a melody mutation handler.

Regarding music sequence handling, when generating a segment of music having several bars, deep learning models have a tendency to generate these bars uniquely. However, real-world music often has some degree of repetition among those bars in the same segment. By introducing such repetition, the music can leave a stronger imprint of its motive and main theme to the listener.

In our invention, we define three types of music sequence: (i) melody sequence: this sequence determines how the main melody is to be repeated. For example, the first 2 bars of Frère Jacques has the same main melody, and bars 3-4 of the song also have the same melody; (ii) beat pattern sequence: this sequence determines how the beat/rhythm pattern is to be repeated. For example, in the Happy Birthday song, the same 2-bar beat/rhythm pattern is repeated four times; and (iii) chord progression sequence: this sequence determines how the chord progression is to be repeated. Unlike melody and beat pattern, the repetition of chord progression is more limited. In the present invention, we only allow chord progression to be repeated from the beginning of the segment because repeating a chord progression from the middle of another chord progression could have a negative effect on the music.

In one embodiment, the music sequence can be extracted from a music database, which includes steps of: (i) identifying the key of the music and perform chord-progression recognition; (ii) splitting music into segments based on recognized chord progression; (iii) extracting the main melody and beat pattern for each bar in the segment; and (iv) utilizing machine learning algorithm to determine which bars have their melody/beat-pattern/chord-progression being repeated.

In another embodiment, when generating a segment of music of n bars, the process is as follows: (i) selecting a music sequence from the database with length n; (ii) based on the selected music sequence and input melody, generating chord progression for current segment, which will match input melody as well as selected music sequence (i.e. repeat previous chords when instructed by music sequence); and (iii) generating melody and beat pattern bar by bar.

In a further embodiment, the step of generating melody and beat pattern bar by bar may include three possibilities. First, a bar with entirely new beat and melody. The system then utilizes deep learning to generate new beat pattern and melody. After generation, the system records generated beat & melody for future use.

Second, a bar needs to repeat a previous beat pattern but does not need to repeat previous melody. The system first loads the previously generated beat pattern. Next, the system uses deep learning to generate the new melody. The generated melody might not match the beat pattern previously generated. Thus, the final step is to align generated melody to the beat pattern. (more on this later) After generation, the system records generated beat & melody for future use. Third, a bar needs to repeat a previous beat pattern and melody. The system can simply load previously generated beat pattern and melody.

In still a further embodiment, the generated melody might not have the same rhythm as the beat pattern previously generated because a beat pattern determines at what time there should be a new note. As a result, the generated melody must be aligned with the beat pattern. For a melody with n notes and a beat pattern requesting m notes, the process of aligning the melody to the beat pattern is as follows:

(i) If n=m: Aligning is straight forward. The system simply modifies the starting time and duration of each note in the melody to match the requirement of the beat pattern.

(ii) If n>m: The system then selects the least significant note in the melody and remove it. The system repeats this process until n=m, and then use the methodology in (i) to align melody to beat pattern. The significance of the notes in the melody is measured by the following criteria:

a. The current chord and key of music. If the pitch of the note matches the key and chord poorly, the note has low significance. For example:

i. In a C-key music under chord C major, the note C #will have a low significance since it matches neither the C scale nor the notes consisting C major chord.

ii. In a C-key music under chord E major, note G #will have a high significance while G will have a low significance. This is because G #is essential to E major chord while G does not match well in E major.

b. Length of the note. Shorter notes have lower significance.

(iii) If n<m: The system then performs the following operation:

a. Remove the beat with the shortest duration from the beat pattern. The removed beat is thus merged with one adjacent beat. This will result in m being reduced by 1. If n=m after removal, then use the methodology in (i) to align melody to beat pattern. Otherwise, go to step (iii)b b. Repeat the most significant note in the melody. The significance is defined in the same fashion as (ii). This operation will result in n being increased by 1. If n=m after removal, then use the methodology in (i) to align melody to beat pattern. Otherwise, go to step (iii)a.

Regarding melody mutation handling, it is known that repetition is very important to music. However, too much repetition can make music sounds boring. As a result, we introduce melody mutation to introduce some more variation to the generated music, while preserving the strengthened motive introduced by music sequence. After each segment of music is generated, we apply music mutation to generated segment. Similar to music sequence, music mutation may include chord mutation, beat mutation and melody mutation. The general mutation process is as follows:

(i) Input generated melody, beat pattern and chord progression;

(ii) For each bar of music, a. "Roll a dice" to determine whether the chord of this bar should be mutated. If true:

i. Change the chord according to manually defined chord mutation rules. The chord mutation rules are based on the key of the music. For example, in C key, Dm can be mutated to Bdim.

ii. After chord mutation, the melody of this bar will be adjusted to match the new chord. For example, when mutating Em to E, all G note in the melody need to change to G #.

b. For each beat in the beat pattern, "roll a dice" to determine whether the beat should be mutated. If true, three possible mutations are applied to the beat:

i. Shorten/lengthen the beat. The length of the next beat will be adjusted as a result.

ii. Merge the beat with the next beat.

iii. Split the beat in to two beats.

c. If beat pattern is modified, align melody to modified beat pattern. The alignment process is described in Music Sequence Handling section.

d. For each note in the melody, "roll a dice" to determine whether the pitch of the note should be mutated. If true, adjust the pitch of the note according to manually defined note mutation rules. The note mutation rules are based on the key of the music and the chord. For example:

i. Under C key and C chord, note G4 can be mutated to C5.

ii. Under C key and Em chord, note G4 can be mutated to B4.

(iii) Repeat step (ii) until all bars have been covered.

In the step of extracting main melody from MIDI (203), the deep learning system (200) is configured to get one track which is most likely to be the main melody of the music to generate. However, it is also possible for the deep learning system (200) to extract more than one main melody from a MIDI file. The data representation of extracting main melody from MIDI (203) (Equation 3) is shown as below:

$$M=\{n_{M_1}, \ldots, n_{M|M|}\}$$

$$n_{Mi}=(t_{Mi}, d_{Mi}, h_{Mi}, v_{Mi})$$

$n_{Mi}$: ith note of melody $t_{Mi}$: Starting tick of ith note of melody $d_{Mi}$: Duration (ticks) of ith note of melody $h_{Mi}$: Pitch of ith note of melody $v_{Mi}$: Intensity (Velocity) of the note ith note of melody Notes in main melody does not overlap Equation 3. Data Representation of Extracting Main Melody In the step of extracting chord progression from MIDI (204), a chord progression is generated through the data representations of extracting chord progression from MIDI (204) (Equation 4) which is shown as below:

$$C=\{(t_{C1}, c_1), \ldots, (t_{C|C|}, c_{|C|})\}$$

$t_{Ci}$: Starting tick of the ith chord.

$c_i$: Shape of ith chord.

Equation 4. Data Representations of Extracting Chord

In the step of extracting beat pattern from MIDI (205), the deep learning system (200) is configured to use heuristic data representations to extract the beat pattern for each bar, and a beat pattern is generated through the data representations of extracting beat pattern from MIDI (205) (Equation 5) which is shown as below:

$$E=E_1 \cup \ldots \cup E_{|B|}$$

$$E_i=\{(t_{E_i1}, e_{E_i1}), \ldots, (t_{E_i|E_i|}, e_{E_i|E_i|})\}$$

$E_i$: Beat for ith bar.

$t_{Eij}$: Tick of the jth beat in ith bar $e_{Eij}$: Type of jth beat in ith bar.

$$E_i \cap E_j=\emptyset, \forall i \neq j$$

Equation 5. Data Representations of Extracting Beat

Moreover, in one embodiment, the chord progression of the generated music is configured to be adjusted according to the generated beat pattern. The deep learning system (200) is adapted to assume a chord change can only happen at a downbeat. The deep learning system (200) is adapted to detect whether there is a chord change for each downbeat and identify which chord is changed when detecting a chord change so as to generate the adjusted chord progression.

In the step of extracting music progression from MIDI (206), a music progression is generated from MIDI, and the data representations of extracting music progression from MIDI (206) (Equation 6) is shown as below:

$$\mathcal{P}=\{(P_1, l_1), \ldots, (P_{|\mathcal{P}|}, l_{|\mathcal{P}|})\}$$

$$P_i=\{b_{P_i1}, \ldots, b_{P_i|P_i|}\}$$

$P_i$: ith part of the song. Each part contains a list of bars $B_{Pij} \in B$. $P_i$ and $P_j$ do not overlap.

$l_i$: Label of ith part of the song (verse, chorus, etc)

Equation 6. Data Representations of Extracting Music Progression

Moreover, after the extracting processes, the deep learning system (200) is configured to be self-trained and developed to a deep learning model in the system (200).

Therefore, in the step of generating a first segment of a full music (130), the main melody, the chord progression, and the beat of the first segment of the full music are respectively generated through the deep learning system (200) in following data representations (Equations 7, 8 and 9), wherein the first segment of the full music is defined as Part x:

$$M_x=\{n_{M_x1}, \ldots, n_{M_x|M_x|}\}$$

$$n_{M_xj}=(t_{M_xj}, d_{M_xj}, h_{M_xj}, v_{M_xj})$$

$n_{M_xj}$: jth note of melody $t_{M_xj}$: Starting tick of jth note of melody $d_{M_xj}$: Duration (ticks) of jth note of melody $h_{M_xj}$: Pitch of jth note of melody $v_{M,j}$: Velocity of jth note of melody
Notes in main melody does not overlap $$M_0 \subseteq M_x$$

$$n_{M,i}=n_{M_0 i}, \forall i \leq |M_0|$$

Equation 7. Data Representations of Extracting Main Melody for Part x $$C_x=\{(t_{C_x 1}, c_{C_x 1}), \ldots, (t_{C_x |C_x|}, c_{C_x |C_x|})\}$$

$t_{C_x i}$: Starting tick of the ith chord.
$c_{C_x i}$: Shape of ith chord.

$$C_0 \subseteq C_x$$

$$(t_{c_x i}, c_{x,i})=(t_{c_0 i}, c_{0,i}), \forall i \leq |C_0|$$

Equation 8. Data Representations of Extracting Chord Progression for Part x $$E_x=E_{x,1} \cup \ldots \cup E_{x,|P_x|}$$

$$E_{x,i}=\{(t_{E_{x,i}1}, e_{E_{x,i}1}), \ldots, (t_{E_{x,i}|E_{x,i}|}, e_{E_{x,i}|E_{x,i}|})\}$$

$E_{x,i}$: Beat for ith bar.
$t_{E_{x,i}j}$: Tick of the jth beat in ith bar
$e_{E_{x,i}j}$: Type (up or down) jth beat in ith bar.

$$E_0 \subseteq E_x$$

$$E_{x,i}=E_{0,i}, \forall i \leq |B_0|$$

$$E_{x,i} \cap E_{x,j}=\emptyset, \forall i \neq j$$

Equation 9. Data Representations of Extracting Beat for Part x

On the other hand, in the step of generating segments other than the first segment to complete the full music (140), the main melody, the chord progression, and the beat of segments other than the first segment are respectively generated through the deep learning system (200) in following data representations (Equations 10, 11 and 12):

$$M'=M'_1 \cup \ldots \cup M'_{|\mathcal{P}|}$$

$$M'_i=\{n_{M'_i 1}, \ldots, n_{M'_i |M'_i|}\}$$

$$n_{M'_i j}=(t_{M'_i j}, d_{M'_i j}, h_{M'_i j}, v_{M'_i j})$$

$M'_i$: Melody of ith part of the song
$n_{M'_i j}$: jth note of melody $M'_i$
Notes in main melody does not overlap $$M'_i \cap M'_j=\emptyset, \forall i \neq j$$

Equation 10. Data Representations of Initial Melody for Full Music $$C_x=\{(t_{C_x 1}, c_{C_x 1}), \ldots, (t_{C_x |C_x|}, c_{C_x |C_x|})\}$$

$t_{C_x i}$: Starting tick of the ith chord.
$c_{C_x i}$: Shape of ith chord.

$$C_0 \subseteq C_x$$

$$(t_{C_x i}, c_{x,i})=(t_{C_0 i}, c_{0,i}), \forall i \leq |C_0|$$

Equation 11. Data Representations of Initial Chord Progression for Full Music $$E_x=E_{x,1} \cup \ldots \cup E_{x,|P_x|}$$

$$E_{x,i}=\{(t_{E_{x,i}1}, e_{E_{x,i}1}), \ldots, (t_{E_{x,i}|E_{x,i}|}, e_{E_{x,i}|E_{x,i}|})\}$$

$E_{x,i}$: Beat for ith bar.
$t_{E_{x,i}j}$: Tick of the jth beat in ith bar
$e_{E_{x,i}j}$: Type (up or down) jth beat in ith bar.

$$E_0 \subseteq E_x$$

$$E_{x,i}=E_{0,i}, \forall i \leq |B_0|$$

$$E_{x,i} \cap E_{x,j}=\emptyset, \forall i \neq j$$

Equation 12. Data Representations of Initial Beat for Full Music

Figure 6:
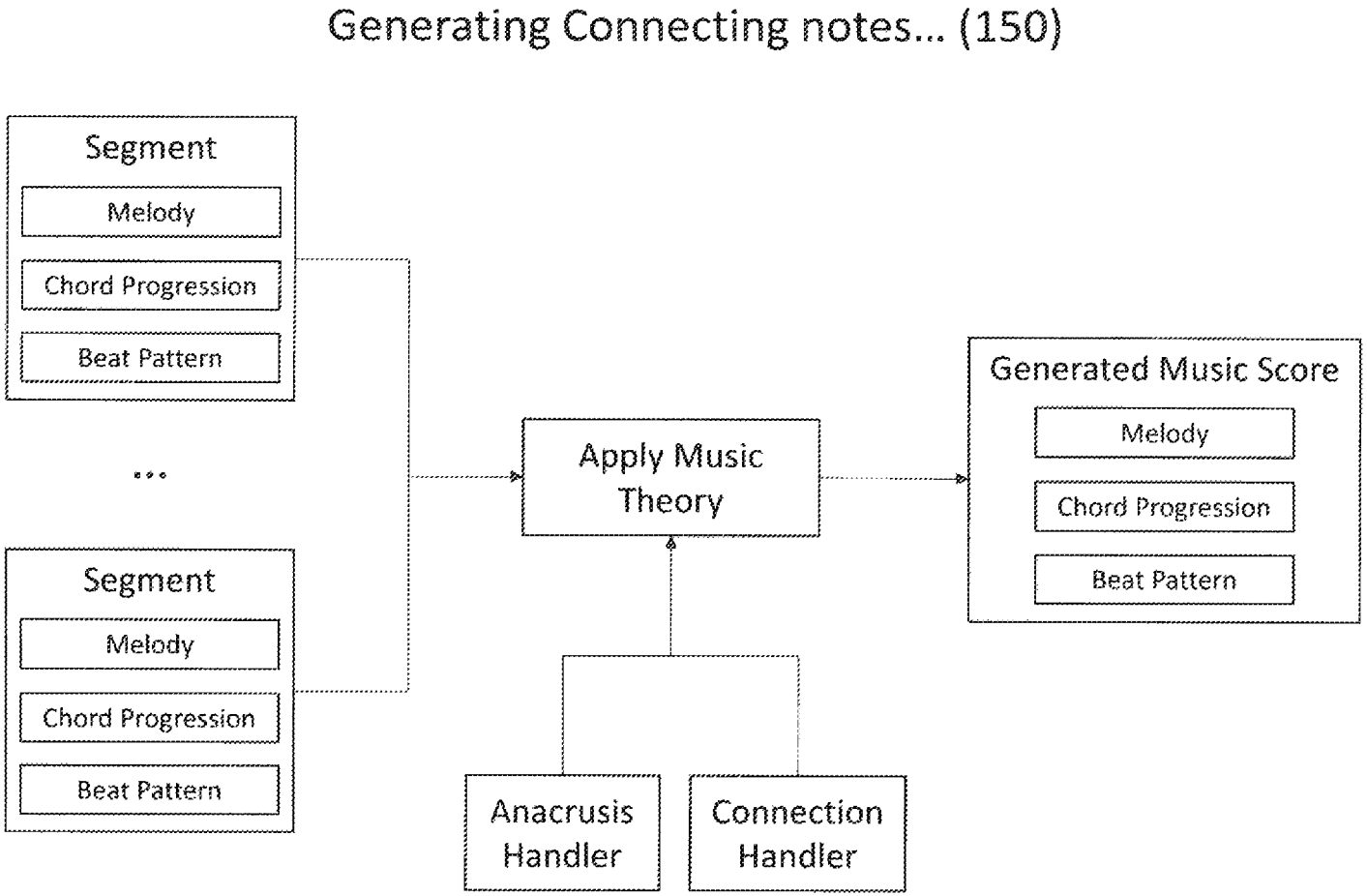
FIG. 6 is a flow chart of step 150 of the method and apparatus for music generation of the present invention.

The step of generating connecting notes, chords and beats of the segments of the full music and handling anacrusis (150) is processing after the full music including melody, chord progression and beat pattern is generated from the deep learning system (200). In this step, a music generating system of the present invention having music theory database is configured to generate connecting notes, chords, and beats between two connected segments and to handle anacrusis such as generating unstressed notes before first bar of a segment, wherein the music theory may include an anacrusis handler and a connection handler as shown in FIG. 6, and the data representations of generating melody, chord progression, and beat for full music (Equations 13, 14 and 15) are respectively shown as below:

$$M'=M'_1 \cup \ldots \cup M'_{|\mathcal{P}|}$$

$$M'_i=\{n_{M'_i 1}, \ldots, n_{M'_i |M'_i|}\}$$

$$n_{M'_i j}=(t_{M'_i j}, d_{M'_i j}, h_{M'_i j}, v_{M'_i j})$$

$M'_i$: Melody of ith part of the song
$n_{M'_i j}$: jth note of melody $M'_i$
Notes in main melody does not overlap $$M'_i \cap M'_j=\emptyset, \forall i \neq j$$

Equation 13. Data Representations of Generating Melody for Full Music $$C_x=\{(t_{C_x 1}, c_{C_x 1}), \ldots, (t_{C_x |C_x|}, c_{C_x |C_x|})\}$$

$t_{C_x i}$: Starting tick of the ith chord.
$c_{C_x i}$: Shape of ith chord.

$$C_0 \subseteq C_x$$

$$(t_{C_x i}, c_{x,i})=(t_{C_0 i}, c_{0,i}), \forall i \leq |C_0|$$

Equation 14. Data Representations of Generating Chord Progression for Full Music $$E=E_1 \cup \ldots \cup E_{|\mathcal{P}|}$$

$$E_i=E_{i,1} \cup \ldots \cup E_{i,|P_i|}$$

$$E_{i,j}=\{(t_{E_{i,j}1}, e_{E_{i,j}1}), \ldots, (t_{E_{i,j}|E_{i,j}|}, e_{E_{i,j}|E_{i,j}|})\}$$

$E_i$: Beat for ith part of the song.
$E_{i,j}$: Beat for ith bar in part $P_i$.
$t_{E_{i,j}k}$: Tick of the kth beat in jth bar in $P_i$
$e_{E_{i,j}k}$: Type (up or down) kth beat in jth bar in $P_i$ $$E_i \cap E_k=\emptyset, \forall i \neq k$$

$$E_{i,j} \cap E_{i,k}=\emptyset, \forall j \neq k$$

Equation 15. Data Representations of Generating Beat for Full Music

Figure 7:
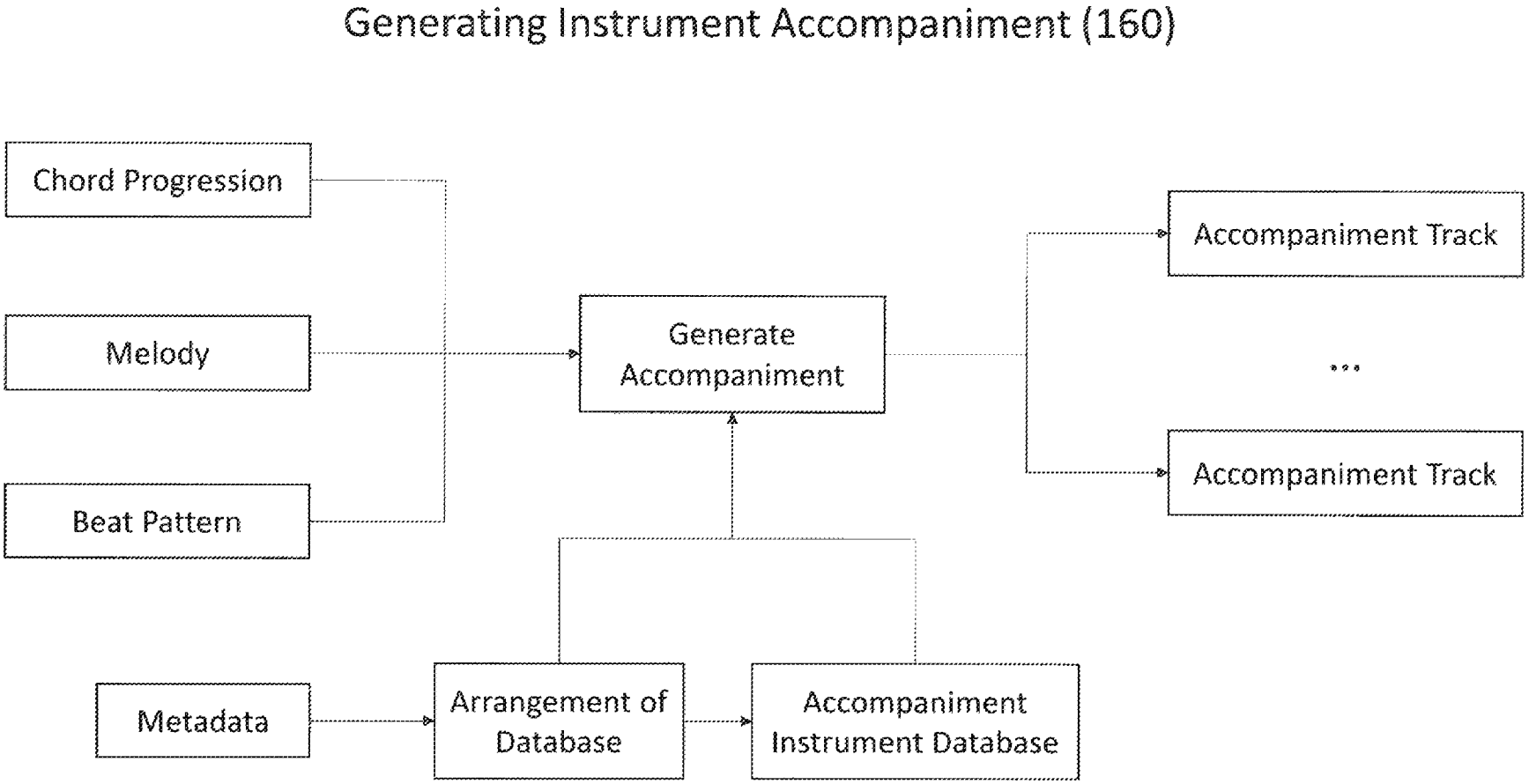
FIG. 7 is a flow chart of step 160 of the method and apparatus for music generation of the present invention.

As shown in FIG. 7, the step of generating instrument accompaniment for the full music (160) is processing after the connecting notes, chords and beats and handling anacrusis is generated for the full music, wherein the data representations of generating instrument accompaniment for the full music (Equation 16) is shown as below:

$$R=\{(R_1, I_1), (R_2, I_2), \ldots, (R_{|R|}, I_{|R|})\}$$

$$R_i=\{(t_{R_i 1}, d_{R_i 1}, n_{R_i 1}), \ldots, (t_{R_i |R_i|}, d_{R_i |R_i|}, n_{R_i |R_i|})\}$$

R: Set of tracks
$R_i$: ith track $I_i$: Instrument of ith track $t_{R_{ij}}$: Starting tick of jth note of the ith track $d_{R_{ij}}$: Duration (ticks) of jth note of the ith track $n_{R_{ij}}$: Pitch of jth note of the ith track $$R_1=M$$

Equation 16. Data Representations of Generating Instrument Accompaniment for Full Music Furthermore, since sometimes the generated music or segments of the full music are not perfectly aligned with the bars thereof, the music generating system of the present invention enable a user to modify generated main melody through the deep learning system (200). After the segment, segments or the full music is generated, a user may have some options such as (i) stopping here; (ii) letting the deep learning system (200) to regenerate selected segments; and (iii) letting the deep learning system (200) to regenerate a full music. Moreover, the music generating system of the present invention is configured to save the input sound for use in future or generating a different music by mixing different saved input sounds through the deep learning system (200).

Figure 3:
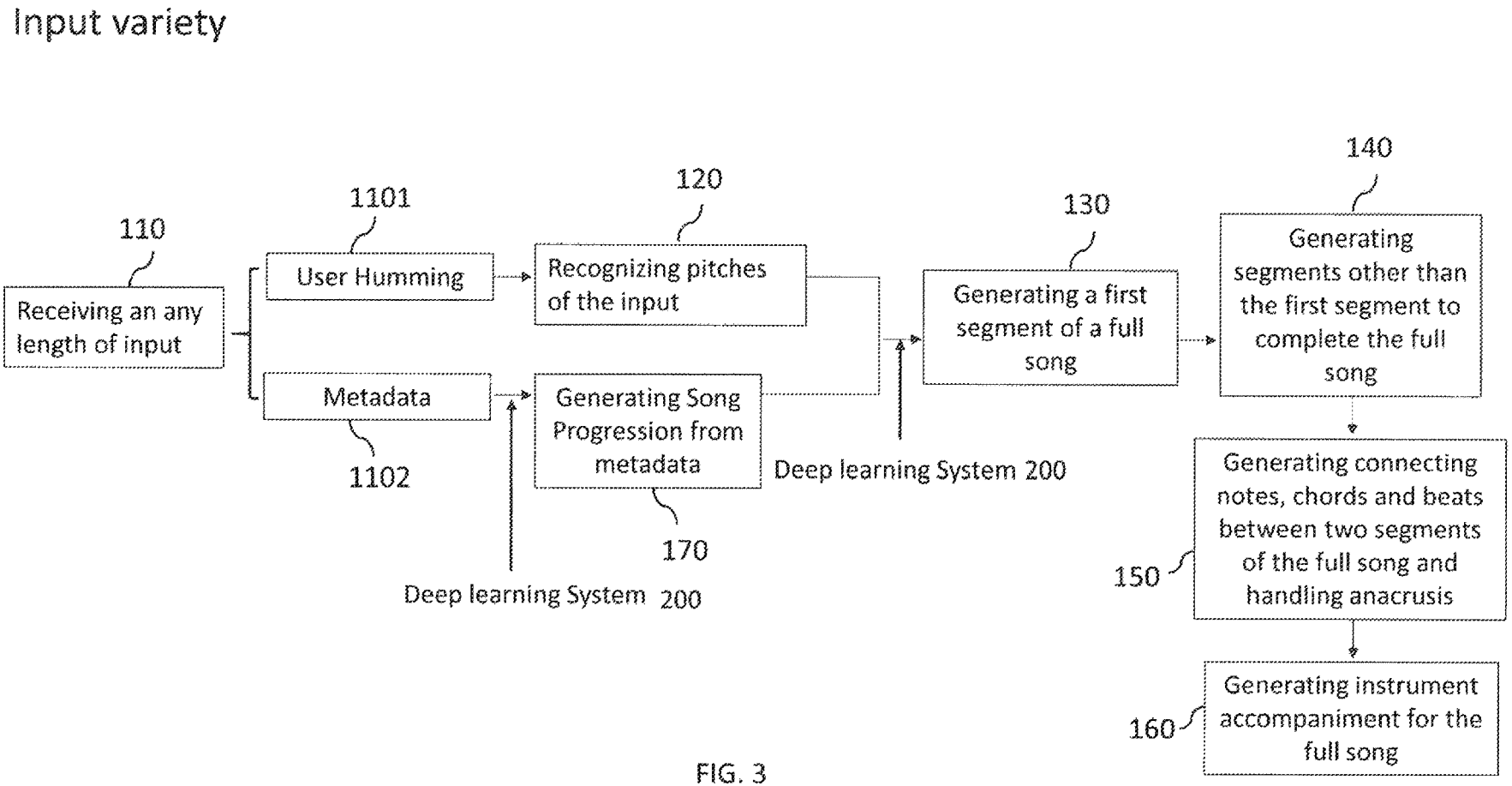
FIG. 3 is a flow chart of another embodiment of the method and apparatus for music generation of the present invention.

In another embodiment, referring to FIG. 3, the system of the present invention is configured to accept different inputs in the same time such as user humming (1101) and metadata (1102), wherein the metadata includes genre and user's mood. The main methodology of generating a first segment of a full music (130) and generating segments other than the first segment to complete the full music (140) are same as the embodiment described above, and the steps of generating a first segment of a full music include receiving any length of input (110); recognizing pitches and rhythm of the input (120); generating music progression form metadata (170); generating a first segment of a full music (130); generating segments other than first segment to complete the full music (140); generating connecting notes, chords and beats between two segments of the full music and handling anacrusis (150); and generating instrument accompaniment for the full music (160), wherein the data representations excepting the generating music progression form metadata are the same as described above, and data representations of generating music progression from metadata (Equation 17) is shown as below:

$$\mathcal{P}=\{(P_1,l_1),\ldots,(P_{|\mathcal{P}|},l_{|\mathcal{P}|})\}$$

$$P_i=\{b_{P_i1},\ldots,b_{P_i|P_i|}\}$$

$$x\in[1,|\mathcal{P}|]$$

$P_i$: ith part of the song. Each part contains a list of bars $B_{P_ij}\in B$. $P_i$ and $P_j$ do not overlap.

x: The part where the initial melody belongs to $l_i$: Label of ith part of the song (verse, chorus, etc)

Some songs are not perfectly aligned with bars. Need some way to represent.

Equation 17. Data Representations of Generating Music Progression From Metadata

In addition, the music generating system of the present invention comprises the deep learning system (200) and means for receiving any length of input (110); recognizing pitches and rhythm of the input (120); generating a first segment of a full music (130); generating segments other than the first segment to complete the full music (140); generating connecting notes, chords and beats of the segments of the full music and handling anacrusis (150); generating instrument accompaniment for the full music (160); and generating music progression from metadata (170).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A method for music generation comprising steps of:

(a) receiving any length of a music input;

(b) recognizing pitches and rhythm of the music input;

(c) generating one or more music segments according to the music input through a computer-implemented learning system;

(d) generating connecting notes, chords and beats of said one or more music segments and handling anacrusis by generating unstressed notes before a first bar of segment; and (e) generating an instrument accompaniment for said one or more music segments.

2. The method for music generation of claim 1, wherein the step of recognizing pitches and rhythm of the input further includes a step of generating an initial short melody, initial bars, and a time signature.

3. The method for music generation of claim 1, wherein the step of generating one or more music segments according to the music input for a full music through a computer-implemented learning system further includes steps of extracting music instrument digital interface (MIDI) data from the music input; extracting score information from said MIDI data; extracting a main melody from said MIDI data; extracting a chord progression from said MIDI data; extracting a beat pattern from said MIDI data; extracting a music progression from said MIDI data; and applying a music theory to the extracted melody, chord progression and beat pattern.

4. The method for music generation of claim 3, wherein the step of applying a music theory includes a step of utilizing a music sequence handler and a melody mutation handler.

5. The method for music generation of claim 4, wherein the step of utilizing the music sequence handler further includes steps of: identifying keys of the music input and perform a chord-progression recognition; splitting the music input into segments based on said chord-progression recognition; extracting a main melody and beat pattern for each bar in each segment; and utilizing said computer-implemented learning system to determine repetition of melody, beat pattern, or chord progression in each bar.

* * * * *